US005300122A

United States Patent [19]

Rodini

[11] Patent Number: 5,300,122

[45] Date of Patent: Apr. 5, 1994

[54] COLORATION OF PEKK FIBERS

[75] Inventor: David J. Rodini, Midlothian, Va.

[73] Assignee: E. I. Du Pont de Nemours and Company, Wilmington, Del.

[21] Appl. No.: 955,274

[22] Filed: Oct. 1, 1992

[51] Int. Cl.[5] ..... C09B 67/00; C09B 67/38

[52] U.S. Cl. ..... 8/607; 8/610

[58] Field of Search ..... 8/607, 610

[56] References Cited

U.S. PATENT DOCUMENTS

| | | | |
|---|---|---|---|
| 3,637,592 | 1/1972 | Barr | 528/194 |
| 3,969,075 | 7/1976 | Forschirm | 8/564 |
| 4,704,448 | 11/1987 | Brugel | 528/125 |
| 4,816,556 | 3/1989 | Gay et al. | 528/176 |
| 5,057,600 | 10/1991 | Beck et al. | 528/480 |

FOREIGN PATENT DOCUMENTS

| | | |
|---|---|---|
| 53-094668 | 8/1978 | Japan . |
| 58-186680 | 10/1983 | Japan . |
| 01-292115 | 11/1989 | Japan . |

OTHER PUBLICATIONS

J. Soc. Dyers Colour, 1973. vol. 89, No. 10 pp. 368–369.

*Primary Examiner*—Linda Skaling
*Assistant Examiner*—Caroline L. Dusheck

[57] ABSTRACT

PEKK fiber is dyed with a disperse dye in an organic dye carrier.

1 Claim, No Drawings

COLORATION OF PEKK FIBERS

BACKGROUND OF THE INVENTION

Polyetherketoneketone (PEKK) has been melt spun into fibers which have potential in the areas of filtration, protective clothing apparel and commercial furnishings. Unfortunately these fibers are difficult to dye under usual textile dyeing conditions since the fibers contain no active dye sites. Conditions normally employed for dyeing polyester have been tried on PEKK fibers (i.e., thermosol dyeing using disperse dyestuffs) with limited success. The present invention not only offers a novel technique for dyeing PEKK fibers, but this technique also stabilizes the fiber to shrinkage.

SUMMARY OF THE INVENTION

In accordance with the present invention, amorphous PEKK yarn is treated in an aqueous dyebath comprising a disperse dye in an aromatic ketone or ether carrier for at least one-half hour at elevated temperatures, there being at least about 40% of the dye carrier present based on the weight of the fiber to be treated and said dye being present in an amount of at least 0.5% based on the weight of the fiber

DETAILED DESCRIPTION OF THE INVENTION

The present invention concerns the dyeing of PEKK fiber whether in the form of staple fiber, continuous filament or woven or nonwoven fibrous sheets. PEKK is a polyetherketoneketone having about two keto groups for each ether group in the polymer. More particularly, those polymers contemplated herein have the following repeating structural unit

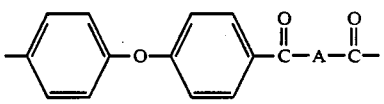

where A is m-phenylene, p-phenylene or both (in different repeat units). Preferably copolymers are employed containing from 25 to 80 mol % of units where A is p-phenylene and 20 to 75 mol % of units where A is m-phenylene. Dyeing of the PEKK fiber according to this invention is carried out with a disperse dye in an aqueous bath containing an aromatic ketone or ether carrier preferably selected from the group consisting of diphenyl ether and acetophenone. Other suitable aromatic ethers are disclosed in U.S. Pat. No. 4,341,526. For effective dyeing, at least 40% of the carrier, based on the weight of fiber to be dyed, should be employed. The remainder of the bath, apart from the dye, is water in an amount generally from 20 to 50 times the weight of fiber to be dyed.

Commonly employed disperse dyes such as are used in dyeing of polyester fiber can be used in the present process. (See J. Soc. Dyers Colour, 1973, V.89, N.10, pp 368–369 for illustrations.) One such dye is Orcocilacron®, a Blue FBL Disperse dye manufactured by Organic Dyestuffs Corp., East Providence, R.I. At least 0.5% of dye should be employed based on the weight of fiber. Those skilled in the art will be readily able to select amounts sufficient to provide deep coloration.

The dyeing process will ordinarily involve heating the fiber in the dye bath at temperatures of about 120° C. to 140 °C. for periods of at least one-half hour; preferably for about one-half to one hour.

The procedure employed in dyeing the fiber both with and without carrier is described below.

Without Carrier

To the sample holder of an Ahiba Turbocolor 1000 laboratory dyeing machine are added 8.5 grams of spun PEKK yarn. The chamber of the dyeing machine is filled with 300 ml. water. Next 0.085 g (1% by weight fiber) of Orcocilacron Blue FBL disperse dye is added. The sample holder is placed in the dyeing chamber and the dye bath is heated to 130° C. at the rate of 6° C./minute. This temperature is maintained for 2 hours, after which the dye bath temperature is reduced to 80° C. at the rate of 6° C./minute and drained. The dyeing vessel is refilled with 300 ml water and 2 ml of Merpol HCS soap solution is added. The temperature of the bath is raised to 80° C. and held there for 10 minutes. The dye bath is then drained. The chamber is then refilled with water, heated to 80° C., held there for 10 minutes and then drained. The fiber is then dried in a hot air oven at 100° C.

With Carrier

To the sample holder of an Ahiba Turbocolor 1000 laboratory dyeing machine are added 8.5 grams of spun PEKK yarn. The chamber of the dyeing machine is filled with 300 ml water. Next 0.085 g (1% by weight fiber) of Orcocilacron Blue FBL disperse dye and the appropriate amount of carrier, determined by weight of fiber, are added to the chamber. The sample holder is placed in the dyeing chamber and the dye bath are heated to 130° C. at the rate of 6° C./minute. This temperature is maintained for 2 hours, after which the dye bath temperature is reduced to 80° C. at the rate of 6° C./minute and drained. The dyeing vessel is refilled with 300 ml water and 2 ml of Merpol HCS soap solution is added. The temperature of the bath is raised to 80° C. and held there for 10 minutes. The dye bath is then drained. The chamber is then refilled with water, heated to 80° C., held there for 10 minutes and then drained. The fiber is then dried in a hot air oven at 100° C.

The following tabulated examples illustrate this invention as well as control Items 1–5, 9 and 10. The dye employed was Orcocilacron®. Except for Item 1, all samples were treated at 130° C. for 45 minutes. The precursor fibers are uncrystallized PEKK fibers of formula I in which A is 60% p-phenylene and 40% m-phenylene.

TABLE

| Item | Carrier* | Dye-stuff* | Comments | Properties (T/E/M)** gpd |
|---|---|---|---|---|
| 1 | none | none | Control | 1.22/32/19 |
| 2 | none | none | Control In Water | .36/183/.52 |
| 3 | none | 1% | In Water | .40/200/.57 |
| 4 | 10% Cindye[1] | 1% | Poor Dye Exhaust | .34/166/.42 |
| 5 | 20% | 1% | Poor Dye Exhaust | .36/131/.64 |
| 6 | 40% | 1% | Complete Dye Exhaust[3] | .24/27/.89 |
| 7 | 80% | 1% | Complete Dye Exhaust[3] | .71/32/14 |
| 8 | 100% | 1% | Complete Dye Exhaust[3] | .65/33/10 |
| 9 | 10% Acetophenone[2] | 1% | Poor Dye Exhaust | .28/54/1.9 |

TABLE-continued

| Item | Carrier* | Dye-stuff* | Comments | Properties (T/E/M)** gpd |
|---|---|---|---|---|
| 10 | 20% | 1% | Poor Dye Exhaust | .49/17/3 |
| 11 | 40% | 1% | Complete Dye Exhaust[3] | .76/24/9.90 |
| 12 | 80% | 1% | Complete Dye Exhaust[3] | .68/31/8 |
| 13 | 100% | 1% | Complete Dye Exhaust[3] | .67/34/7.6 |

*By weight of fiber
**T/E/M = Tenacity (gpd)/Elongation (%)/Modulus (gpd)
[1]Cyndye 45 is an Aryl Ether dye carrier manufactured by Stockhausen
[2]Acetophenone (Dymex) is a dye carrier manufactured by Sandoz
[3]The dye bath became essentially colorless.

When dyed according to this invention, the PEKK fibers shrink little, if at all, as evidenced by their relatively low elongation as compared to those fibers which have been dyed in water or in aqueous dye baths containing less than 20% of carrier based on the weight of fiber treated. The fibers dyed by the process of the invention exhibited deep bright coloration as compared to the controls.

I claim:

1. A process for dyeing and reducing the shrinkage of a fiber of a polyetherketoneketone having the following repeating structural unit

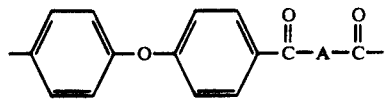

where A is m-phenylene, p-phenylene or both m-phenylene and p-phenylene present in different repeating units, comprising treating the fiber for at least about one-half hour at a temperature of about 120° C. to 140° C. in an aqueous bath of a carrier containing a disperse dye, said carrier being selected from the group consisting of diphenyl ether and acetophenone and being present in an amount of at least 40% based on the weight of the fiber to be treated and said dye being present in an amount of at least 0.5% based on the weight of the fiber.

* * * * *